US007837491B2

(12) United States Patent
Collin

(10) Patent No.: US 7,837,491 B2
(45) Date of Patent: Nov. 23, 2010

(54) CONNECTOR COUPLING

(75) Inventor: Edwin J. Collin, Southington, CT (US)

(73) Assignee: Glenair, Inc., Glendale, CA (US)

( * ) Notice: Subject to any disclaimer, the term of this patent is extended or adjusted under 35 U.S.C. 154(b) by 0 days.

(21) Appl. No.: 12/352,230

(22) Filed: Jan. 12, 2009

(65) Prior Publication Data

US 2010/0178788 A1 Jul. 15, 2010

(51) Int. Cl.
*H01R 13/62* (2006.01)

(52) U.S. Cl. ..... 439/317

(58) Field of Classification Search ..... 439/311–319, 439/345

See application file for complete search history.

(56) References Cited

U.S. PATENT DOCUMENTS

| | | | |
|---|---|---|---|
| 1,568,442 | A | 1/1926 | Carver |
| 4,672,755 | A | 6/1987 | Benoit et al. |
| 5,423,692 | A | 6/1995 | Francis |
| 5,558,533 | A | 9/1996 | Hashizawa et al. |
| 5,627,448 | A | 5/1997 | Okada et al. |
| 5,662,488 | A * | 9/1997 | Alden ..... 439/314 |
| 6,227,891 | B1 | 5/2001 | Collin et al. |
| 6,336,822 | B1 | 1/2002 | Luzzoli |
| 7,416,438 | B2 | 8/2008 | Hashiguchi et al. |
| 2002/0090855 | A1 | 7/2002 | Rodney, Sr. |
| 2002/0101076 | A1 | 8/2002 | Barrier |

OTHER PUBLICATIONS

Int'l Search Report, Mar. 24, 2010.

* cited by examiner

*Primary Examiner*—Jean F Duverne
(74) *Attorney, Agent, or Firm*—John S. Paniaguas; Katten Muchin & Rosenman LLP

(57) ABSTRACT

An electrical power connector is disclosed, configured as either a plug connector or a receptacle connector, which includes at least one retractable lever that provides a mechanical advantage to the user to facilitate the coupling and uncoupling of a plug connector to a receptacle connector. The retractable lever is suitable for applications in which space is relatively limited. The plug connector and the receptacle connector are each connected to an electrical cable on one end. The opposing ends of the plug connector and the receptacle connector are configured to mate with each other so that there is a continuous electrical current path from the cable connected to the plug connector to the cable connected to the receptacle connector. In accordance with an important aspect of the invention, the retractable lever is rotatably connected to one or the other of the plug connector or the receptacle connector.

17 Claims, 9 Drawing Sheets

*Plug in the full open position where the bayonet pins of the plug connector enter the bayonet ramps of the receptacle connector*

*fully opened*

*point of initial resistance*

*fully opened*

*point of initial resistance*

*open pull to open lever to un-couple*

*fully closed with lever released*

*look at the rear of the plug couple / un-couple sequence of two adjacent connectors*

*Plug in the full open position where the bayonet pins of the plug connector enter the bayonet ramps of the receptacle connector*

*Plug in the full couple position where the bayonet pins of the plug connector enter the bayonet ramps detents of the receptacle connector where the plug full couple indicator is in line with the receptacle full couple indicator*

*Section view of plug and receptacle mated with the handle extended showing the relationship of features*

*Plug connector lever identification*

CONNECTOR COUPLING

BACKGROUND OF THE INVENTION

1. Field of the Invention

The present invention relates to an electrical connector assembly for releasably connecting electrical cables together and more particularly to an electrical power connector that is configured as either a plug connector or a receptacle connector which includes at least one retractable lever that provides a mechanical advantage to the user to facilitate the coupling and uncoupling of a plug connector to a receptacle connector.

2. Description of the Prior Art

Electrical connectors are known in the art for releasably connecting electrical cables together. Such electrical connectors are known to include a plug connector and a mating receptacle or socket connector and are known to be used in various applications including power cable and signal cable applications. Power cable applications include electrical vehicles, industrial equipment and mass transit applications as well as other high power applications. For example, known mass transit applications require electrical power connectors for the connection of the power supply to the traction motors on each subway car. Such electrical power connectors are typically rated for 800 volts/350 amps AC. Examples of such electrical power connectors are disclosed in U.S. Pat. Nos. 5,423,692; 5,423,692; 6,227,891; 6,336,822 and 7,416,438, all hereby incorporated by reference.

Electrical power connectors are known that are formed as circular connectors with both circular threaded coupling configurations and reverse bayonet coupling configurations. In many applications including mass transit applications, electrical power connectors with reverse bayonet configurations are preferred for several reasons. In particular, electrical power connectors with reverse bayonet coupling configurations provide a more positive coupling than electrical power connectors with circular threaded coupling configurations. In addition, such electrical power connectors with reverse bayonet coupling configurations provide improved vibration resistance and provide a better moisture seal than electrical power connectors with circular threaded coupling configurations.

Because of the relatively high anticipated vibration in certain applications, such as mass transit applications, the circular electrical power connectors used in such applications are configured to resist rotation. In other words, such electrical power connectors for use in high vibration applications are configured such that a relatively large decoupling force is required to initiate decoupling of the plug connector from the receptacle connector. Such a configuration also results in requiring a relatively large coupling force to couple the plug connector to the receptacle connector. Given the fact that such electrical power connectors are relatively heavy because of the relatively large size required to accommodate, the power requirements, such electrical power connectors are relatively difficult to couple and un-couple.

In order to address this problem, various configurations of electrical power connectors with external levers have been developed to provide a mechanical advantage to the user in order to overcome the relatively large coupling and decoupling forces inherent in such electrical power connectors. For example, U.S. Pat. No. 6,336,822 discloses an electrical power connector which includes a plug connector and a receptacle connector formed with a reverse bayonet coupling configuration. The receptacle connector includes a mounting flange that enables the receptacle connector to be rigidly secured, for example to panel or plate. The plug connector is formed with a radially extending handle or lever. The radially extending handle or lever is fixed in place. Once the receptacle connector is secured in place, the radially extending handle provides sufficient leverage to enable a user to overcome the relatively high coupling force. Although the radially extending lever on the plug connector disclosed in the '822 patent overcomes the problem associated with the coupling force of such power connectors, it is only suitable for use in applications where there is sufficient space for the radially extending handle in the coupled position. Moreover, with such a configuration, the radially extending handle is inappropriate for applications where space is limited and there is no room for the fixed extending handle.

U.S. Pat. No. 6,227,891 addresses this problem by providing a retractable lever on a plug connector. The retractable lever is rotatable about an axis that is generally perpendicular to the axial axis of the connector assembly. A detent mechanism is provided to lock the lever in either an extended position or a stored position. The receptacle connector is configured with a flange to enable the receptacle connector to be secured in place. In order to provide a sufficient mechanical advantage to overcome the coupling and uncoupling forces of relatively large power connectors, a relatively long lever is provided which extends outwardly from the plug connector and in a stored position the extending end of the lever rests against the receptacle connector. As such, the configuration disclosed in the '891 application is not suitable for applications where space is limited. Also, with the configuration provided with the power connector disclosed in the '891 application, the coupling/uncoupling forces are applied to the radial pivot axis of the lever. As such, the pivot and the lever must be designed to accommodate such force which adds to the expense of the connectors.

Thus, there is a need for an electrical connector assembly which facilitates coupling and decoupling of the connector assembly for use in applications where space is relatively limited.

SUMMARY OF THE INVENTION

The present invention relates to an electrical power connector, configured as either a plug connector or a receptacle connector, which includes at least one retractable lever that provides a mechanical advantage to the user to facilitate the coupling and uncoupling of a plug connector to a receptacle connector. In accordance with an important aspect of the invention, the retractable lever is suitable for applications in which space is relatively limited. The plug connector and the receptacle connector may be formed with a generally circular cross section. The plug connector and the receptacle connector are each connected to an electrical cable on one end. The opposing ends of the plug connector and the receptacle connector are configured to mate with each other so that there is a continuous electrical current path from the cable connected to the plug connector to the cable connected to the receptacle connector. In accordance with an important aspect of the invention, the retractable lever is rotatably connected to one or the other of the plug connector or the receptacle connector. The lever is configured to rotate about a pivot axis generally parallel to the axial axis of the connector. The connector is further configured to be rotatable from a storage position in which the lever rests against a coupling ring and an extended position in which the lever is extended radially outwardly from the coupling ring In the extended position, the lever provides a mechanical advantage to facilitate the coupling or uncoupling of the plug connector with respect to the receptacle connector. In one embodiment of the invention, a retractable lever for assisting in both the coupling and uncoupling directions. The retractable levers may be spring biased to return to the storage positions.

DESCRIPTION OF THE DRAWING

These and other advantages of the present invention will be readily understood with reference to the following specification and attached drawing wherein.

DETAILED DESCRIPTION

The present invention relates to an electrical connector assembly for releasably connecting electrical cables together and more particularly to an electrical power connector that is configured as either a plug connector or a receptacle connector which includes at least one retractable lever that provides a mechanical advantage to the user to facilitate the coupling and uncoupling of a plug connector to a receptacle connector.

As used herein, the term "connector" without a modifier, such as plug or receptacle, is used to describe either a plug connector or receptacle or socket connector. In accordance with the present invention, at least one rotatable lever may be disposed on either the plug connector or the receptacle connector. As shown and described, a pair of levers is provided on one of the connectors. In that embodiment, one lever is used to facilitate coupling of the connectors while the other lever is used to facilitate uncoupling of the connectors. The principles of the present invention are also applicable to connector assemblies which are used to facilitate one or the other of either coupling or uncoupling of the connectors. In addition, the principles of the present invention are also applicable to embodiments in which a single rotatable lever is used and locked in place, for example by a locking mechanism (not shown).

Figures 1, 2:
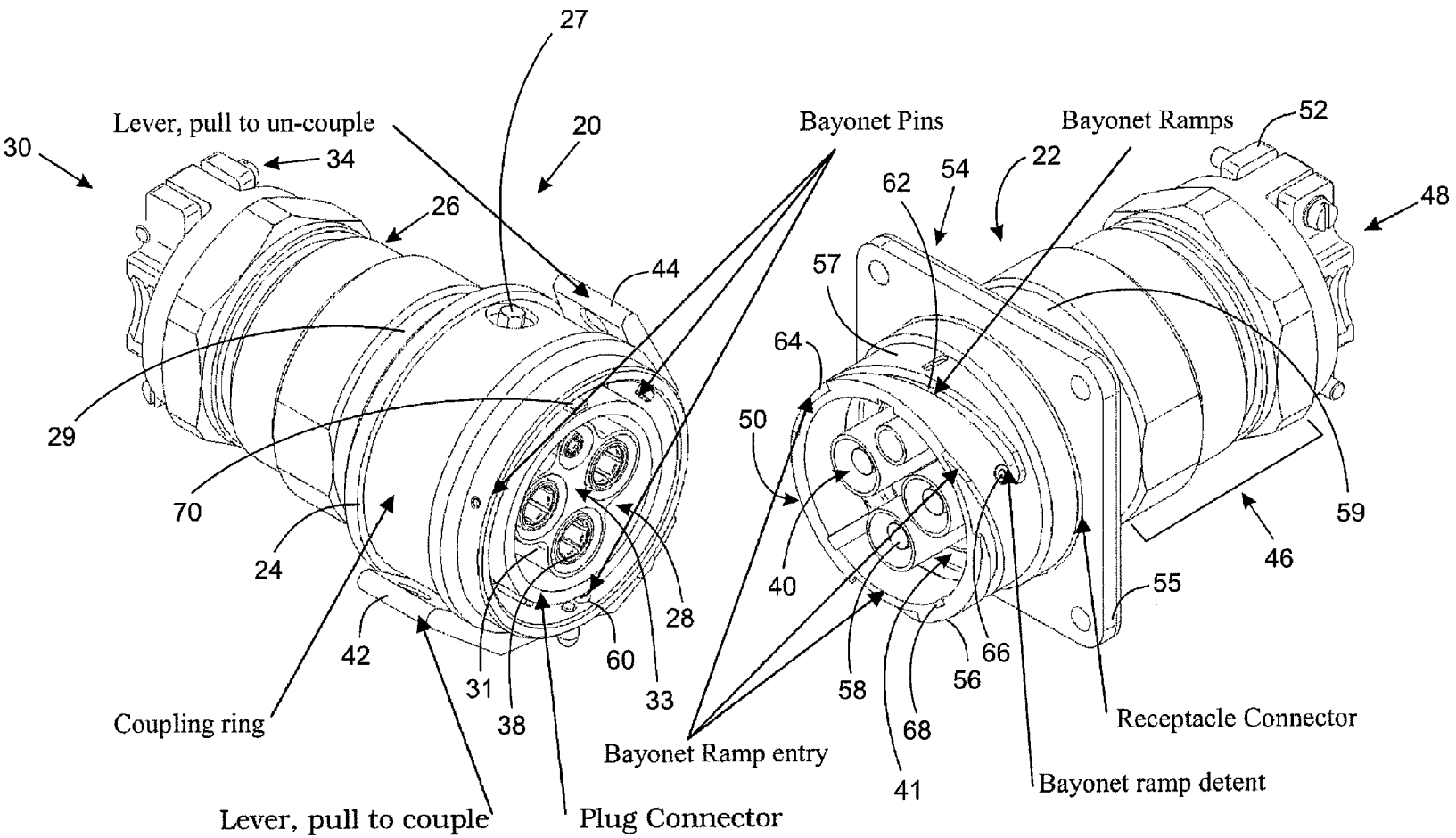
FIG. 1 is an isometric view of one embodiment of a plug connector in accordance with the present invention showing the front interface with the coupling ring with bayonet studs and the two levers used to couple and uncouple the connector from its mating receptacle and an optional full couple tactile indicator.
FIG. 2 is an isometric view of the mating receptacle showing the bayonet ramps that engage the bayonet pins of the receptacle and the full couple tactile indicator.

Turning to FIG. 1, an exemplary plug connector, generally identified with the reference numeral 20 is illustrated. The plug connector 20 is configured to mate with the receptacle connector 22, illustrated in FIG. 2. The principles of the present invention are applicable to virtually any connector assembly, for example, the power connector assembly illustrated and described in U.S. Pat. No. 6,336,822, hereby incorporated by reference. The plug connector 20 is formed as an assembly and includes a coupling ring 24, generally cylindrical plug housing, generally identified with the reference numeral 26 and a plug connector body 29. In order to facilitate coupling and uncoupling of plug connector 20 and the receptacle connector 22, the coupling ring 24 is partially rotatable with respect to the plug receptacle body 26. The degree of angular rotation of the coupling ring 24 is controlled by internal stops (not shown) internal to the plug housing 26 and a radial fastener 27. The coupling ring 24 is configured to rotate to enable a reverse bayonet coupling assembly to engage and to enable the plug connector 20 to be fully coupled with the receptacle connector 22, as will be discussed in more detail below.

Figure 8:
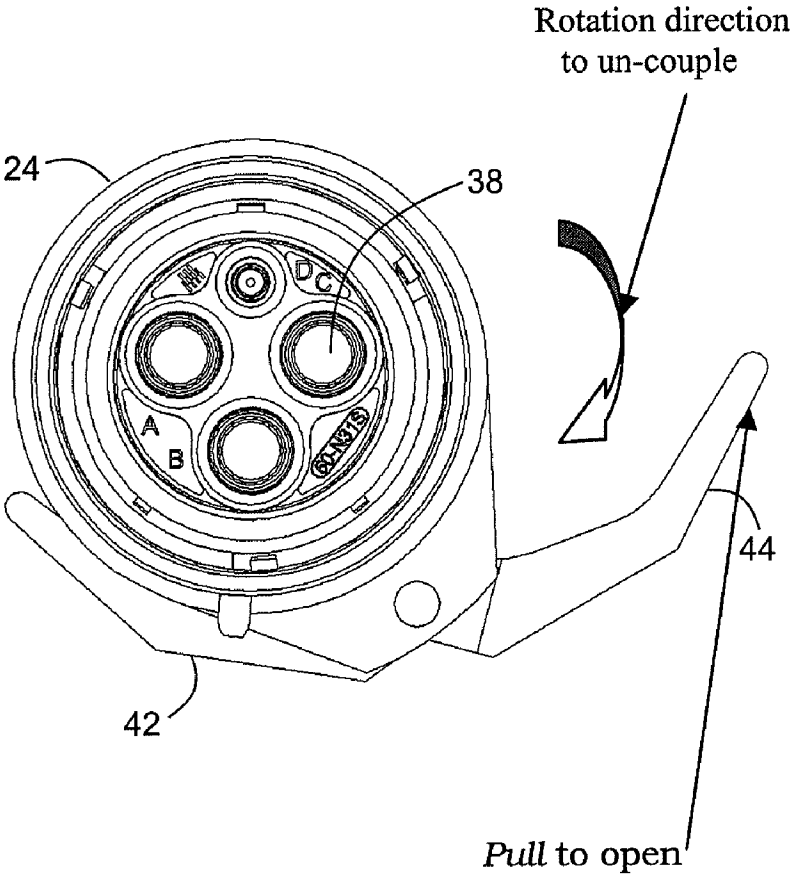
FIG. 8 is a front view of the plug connector where the coupling ring is fully rotated as in FIGS. 6 and 7 but with the open lever extended to assist the rotation to un-couple the coupling ring from the receptacle.
Figure 9:
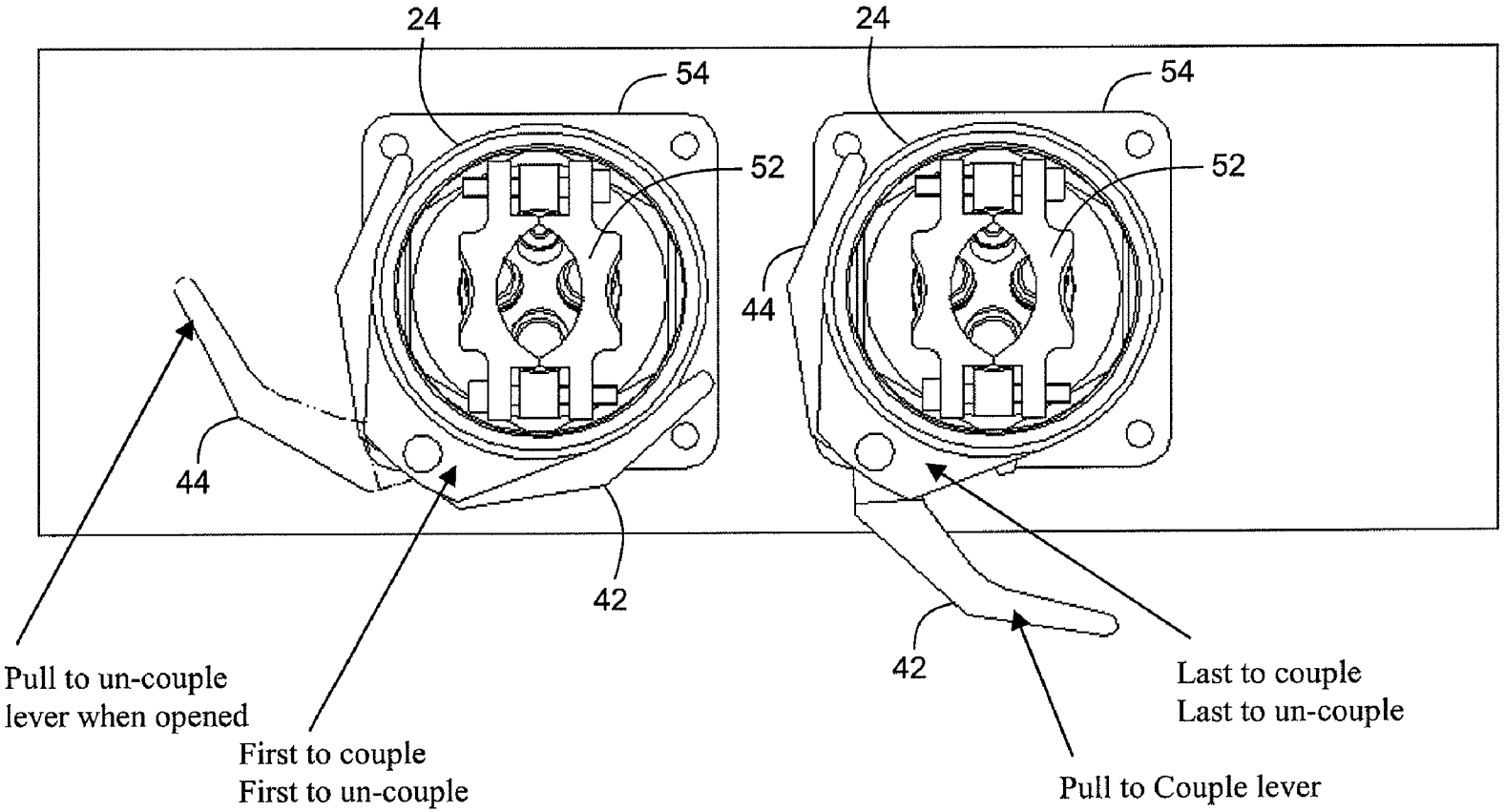
FIG. 9 is a rear view of two plug connectors mated to their receptacles on a panel with the connectors mounted in close proximity of each other. The opening and closing of the plug coupling ring can be operated in this close proximity in a sequence.

The plug receptacle 20 includes a mating end 28 and an opposing cable end 30. The cable end 30 may be threaded for receiving a stress relief assembly 34 which is configured to be threaded onto the cable end 30. As best shown in FIG. 9, the stress relief assembly 34 includes a clamp assembly 36 for securing an electrical cable in place relative to the plug assembly 20. The plug connector 20 also includes electrical terminals, generally identified with the reference numeral 38, that are configured to receive the electrical conductors making up the electrical cable. An exemplary 800 volt/350 amp AC power connector is shown in FIGS. 1-13 which includes four (4) terminals, three (3) large terminals: power (L1), return (L2) and neutral (N) and a relatively smaller ground terminal (G). The plug connector body 29 and the cylindrical plug housing 26 are threaded to enable these parts to be secured together. The cylindrical plug housing 26 to enable bare electrical conductors (not shown) to be electrically coupled, for example, by crimping, into a rear wire hole of one the electrical terminals 38. The electrical terminals 38 may be carried by a generally cylindrical insulator 31, formed from a dielectric material and formed with holes (not shown) for receiving the electrical terminals 38 and axially securing the terminals 38 with respect to the plug connector body 29 forming an insulator assembly 33. After the bare electrical conductors (not shown) are electrically connected to the terminals 38, the terminals 38, the terminals 38 are inserted into the corresponding location in the cylindrical insulator 31 forming an insulator assembly 33. The insulator assembly 33 is then inserted into the plug connector body 29, which, in turn, is secured to the plug housing 26. The free ends of the terminals 38 (FIG. 1), as accessible from the mating end 28 of the plug connector 20, are configured to mate with corresponding terminals, generally identified with the reference numeral 40, on the receptacle connector 22.

A receptacle connector 22 is illustrated in FIG. 2. The receptacle connector 22 includes a receptacle connector body 46 and a flange body assembly 54 and defines a cable end 48 and a mating end 50. The receptacle body 46 may be threaded for receiving a stress relief assembly 52, similar to the stress relief assembly 34, optionally provided on the plug connector 20. A flange body assembly, generally identified with the reference numeral 54, includes a flange 55 and a threaded cylindrical housing 59. The threaded cylindrical housing 59 is configured to be secured to the receptacle connector body 46. The flange body assembly 54 allows the receptacle connector 22 to be secured to a plate (not shown). The receptacle connector body 46 may be uncoupled from the flange body assembly 54 to enable bare electrical conductors (not shown) to be crimped into the rear wire holes of the terminals 38 before it is inserted into its respective position in the insulator 41 and secured to the threaded cylindrical housing 59, and, in turn, secured to the connector body 46, in a similar manner as discussed above.

The mating end 50 of the receptacle connector 22 includes an extending throat 56 formed with a relatively a larger diameter than the outer diameter of the mating end 28 of the connector body 26 of the plug receptacle 20 and smaller than the inner diameter of the coupling ring 24 of the plug receptacle 20. Mating terminals, generally identified with the reference numeral 58, are disposed within the inner diameter of the receptacle connector body 46. These terminals 58 are connected to electrical conductors (not shown) on one end and are configured on the mating end 50 to mate with the terminals 38 on the plug connector 20.

Coupling between the plug connector 20 and the receptacle connector 22 may be configured as reverse bayonet. As such, a plurality of bayonet pins, for example three (3), are disposed on the inner diameter of the coupling ring 24. The bayonet pins 60 are configured to be received corresponding bayonet ramps 62 formed on the outer diameter of the extending throat 56 on the receptacle connector 22. Each of the bayonet ramps 62 is formed with an entry point 64 on one end and a ramp detent 66 on an opposing end.

In order to couple the plug connector 20 to the receptacle connector 22, it is necessary to align the terminals 38 on the plug connector with the terminals 58 on the receptacle connector 22. As such, an alignment mechanism may be provided. An exemplary alignment mechanism is illustrated and may include a plurality of elongated axial slots 68, radially disposed around the inner diameter of the extending throat 66 on the receptacle connector 22. These slots 68 are configured to receive corresponding ribs 70 formed on the mating end 28 on the outer diameter of the plug connector body 26. Once the ribs 70 are aligned with the slots 68, the plug connector 20 and be moved in an axial direction toward the receptacle connector 22 so that the bayonet pins 60 on the plug connector 20 are received in the bayonet ramp entry points 64 which defines the point of initial coupling resistance. As will be discussed in more detail below, rotation of the coupling ring 24 causes the plug receptacle 20 and the receptacle connector 22 to be further moved toward each other in an axial direction and allows the connection between the plug connector 20 and the receptacle connector 22 to be locked in place.

Figures 3, 4:
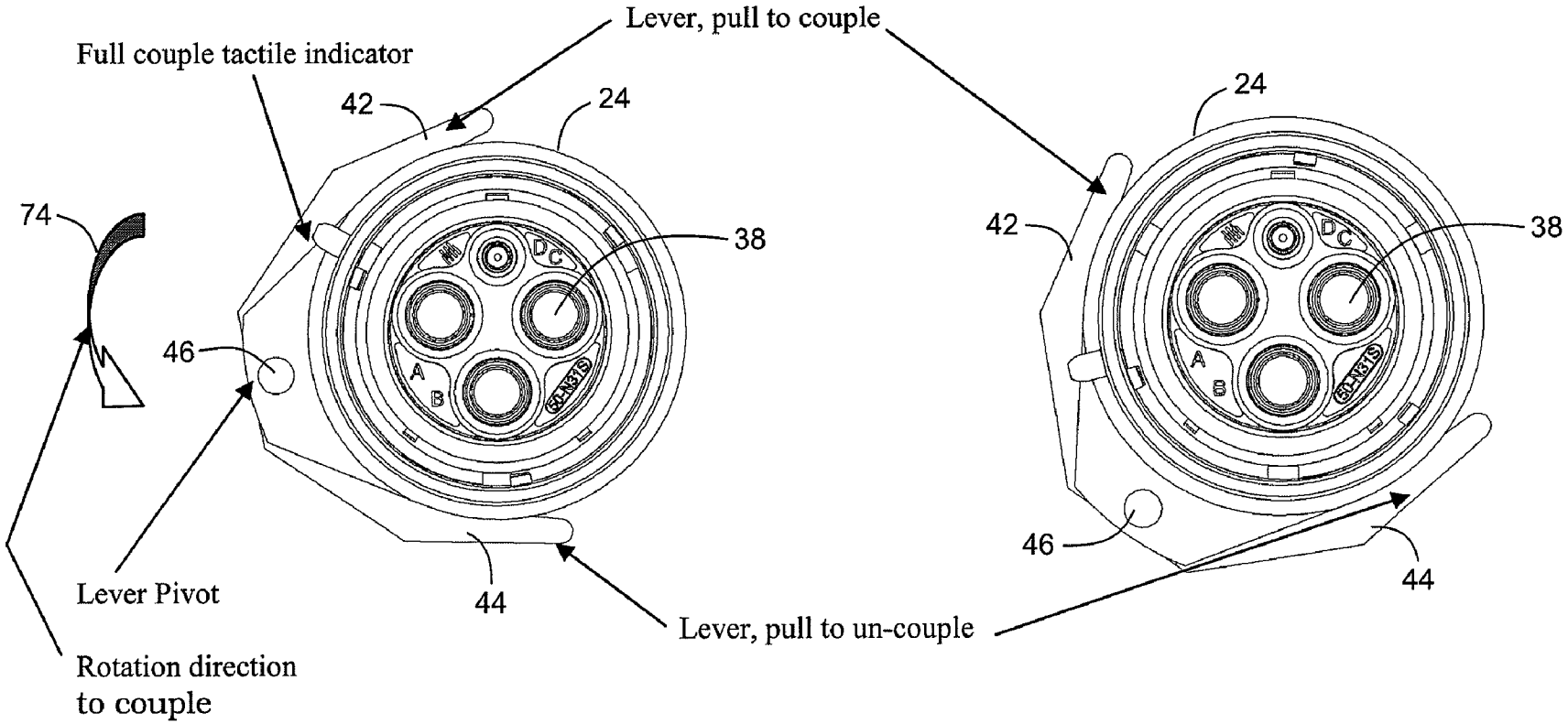
FIG. 3 is a front view of the plug connector with the coupling ring rotated to an internal stop where the bayonet pins can enter the ramps of the receptacle.
FIG. 4 is a front view if the plug connector showing the coupling ring rotated to a point of initial resistance when mating with the receptacle.

In accordance with an important aspect of the invention, a coupling lever 42 and an uncoupling lever 44 are provided. These levers 42 and 44 are rotatably mounted about a pivot axis 46 (FIG. 3) that is generally parallel to the axial axis of the generally circular connector. More particularly, the two levers 42 and 44 are opposed to each other on either side of a coupling ring 24, each pivoting from the same axial pivot 46, as best shown in FIG. 3. The axial pivot 46 of the two levers 42 and 44 allows the operation of the lever 42, 44 to be performed easily while coupling before the point of initial resistance due to the reverse bayonet coupling configuration and also during un-coupling after the resistance force is removed. The levers 42 and 44 can also be rotatably mounted about different pivot axes.

Figures 5, 6:
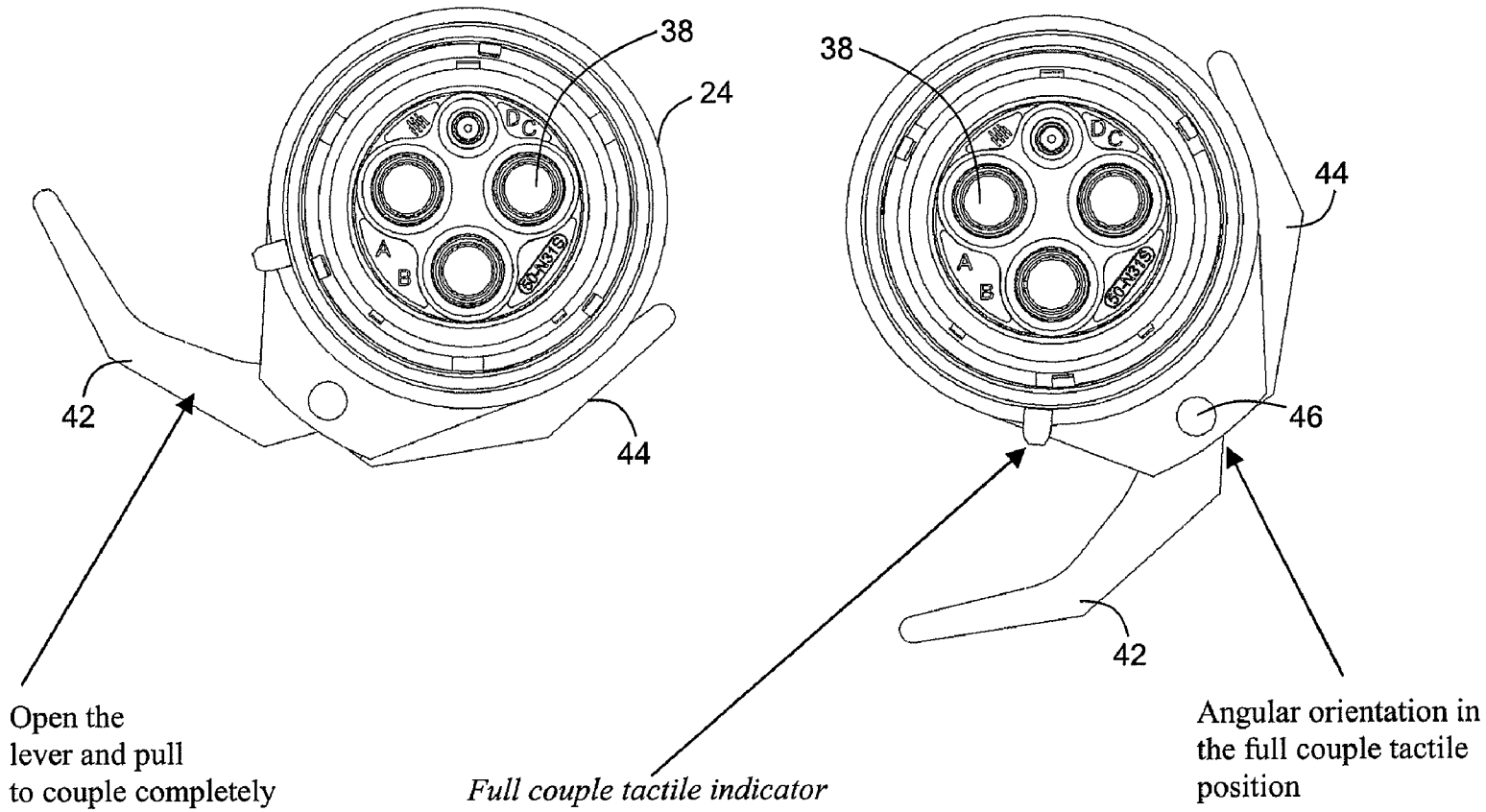
FIG. 5 is a front view of the plug connector showing the couple lever extended to assist in the coupling ring rotation to couple with the receptacle.
FIG. 6 is a front view of the plug connector where the coupling ring is fully rotated and the bayonet pins have fallen into their detent positions in the receptacle ramp slots and the couple lever extended.

The levers 42 and 44 are normally in a storage position, nested against the coupling ring 24, for example, as shown in FIGS. 1, 3, 4 and 7. An extended position is illustrated in FIGS. 5 and 6 for the lever 42 and FIG. 8 for the lever 44. As shown, the levers rotate radially outwardly relative to the plug connector 22 thereby enabling the connector assembly to be used in applications where space is limited.

Figure 12:
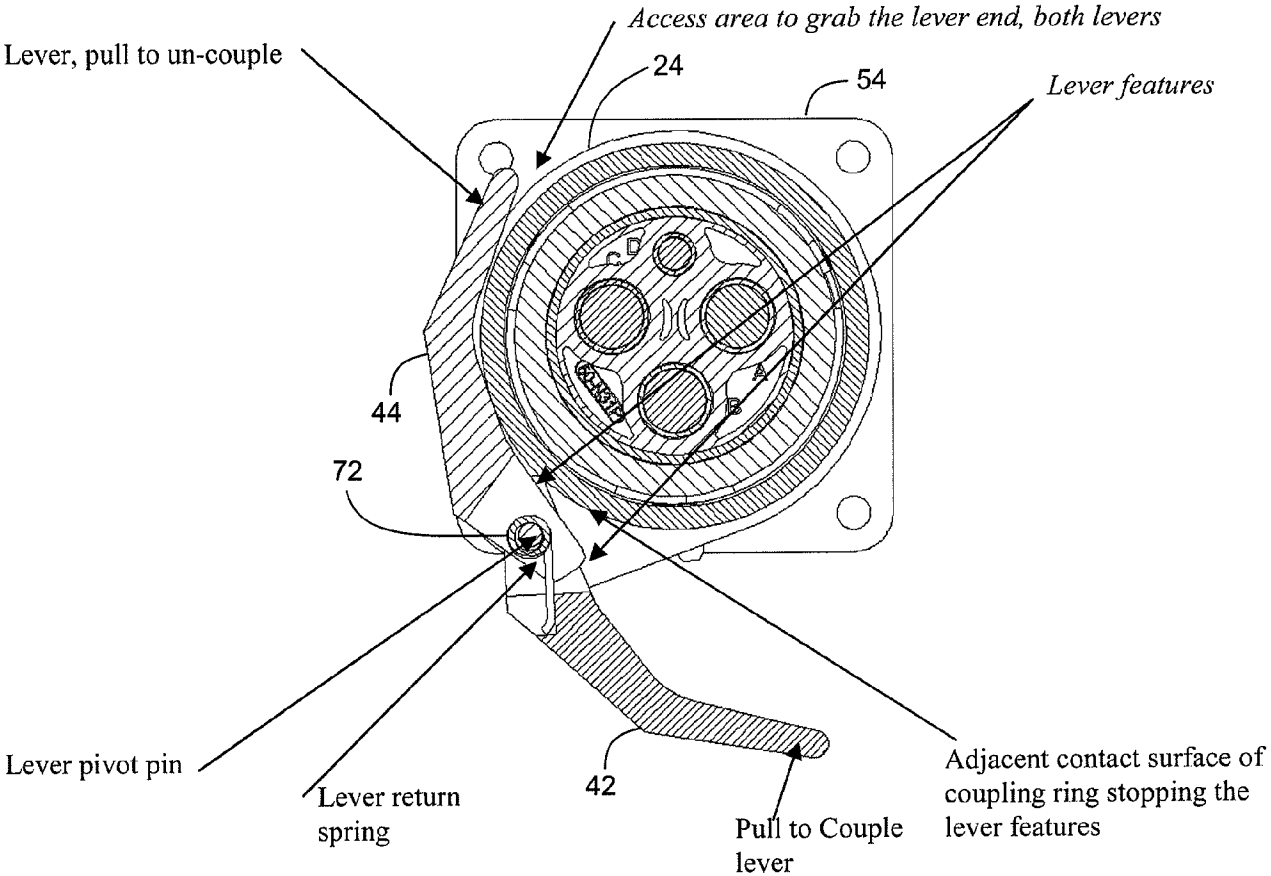
FIG. 12 is a section view transversely cut through the coupling ring illustrating the position of the lever, lever pivot, lever return (torsion) spring, lever features and the adjacent surface of the coupling ring.
Figure 13:
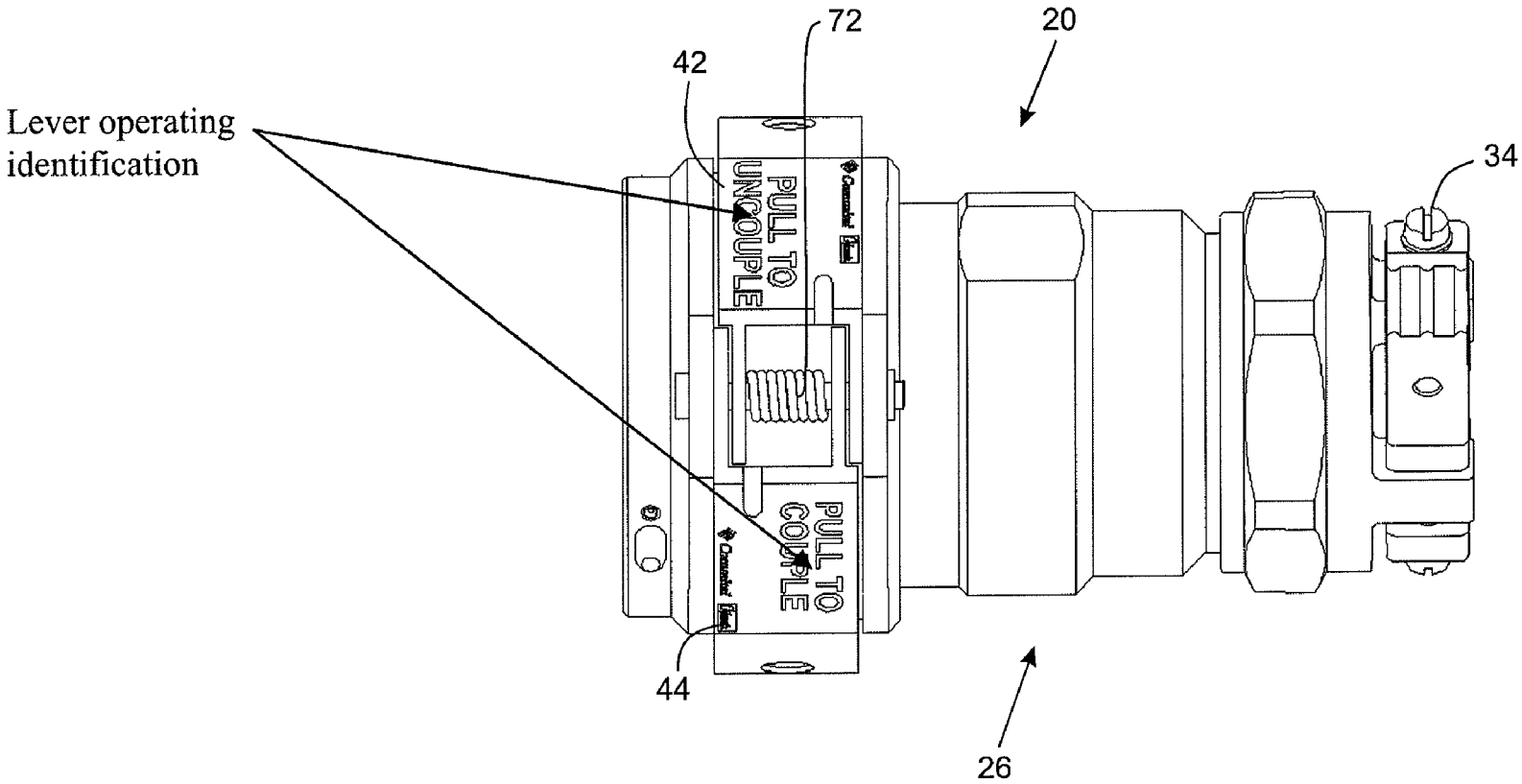
FIG. 13 is a bottom view of the plug connector showing the lever markings.

In one embodiment of the invention, the levers 42, 44 are biased against the coupling ring 24 by way of a single torsion spring 72 (FIG. 13) and held there by a spring force which is light enough to pull open easily but strong enough to return reliably. Alternatively, a separate spring may be used for each lever 42, 44. Each lever 42, 44 is configured to be operated independently with access on the outward end to enable the lever 42, 44 to be placed in an extended position, as discussed above. In an extended position, the opposing ends of the levers 42, 44 contact the outer surface of the coupling ring 24, as shown in FIG. 12, which stops the rotation of the levers 42, 44 at a position, for example, as shown in FIGS. 5 and 8. It is also contemplated that each lever 42, 44 can be configured to stop against the opposing lever in an extended position. In the extended position, force applied to either of the levers 42, 44 is translated to a torque that causes coupling ring 24 to rotate in the desired direction.

Figure 7:
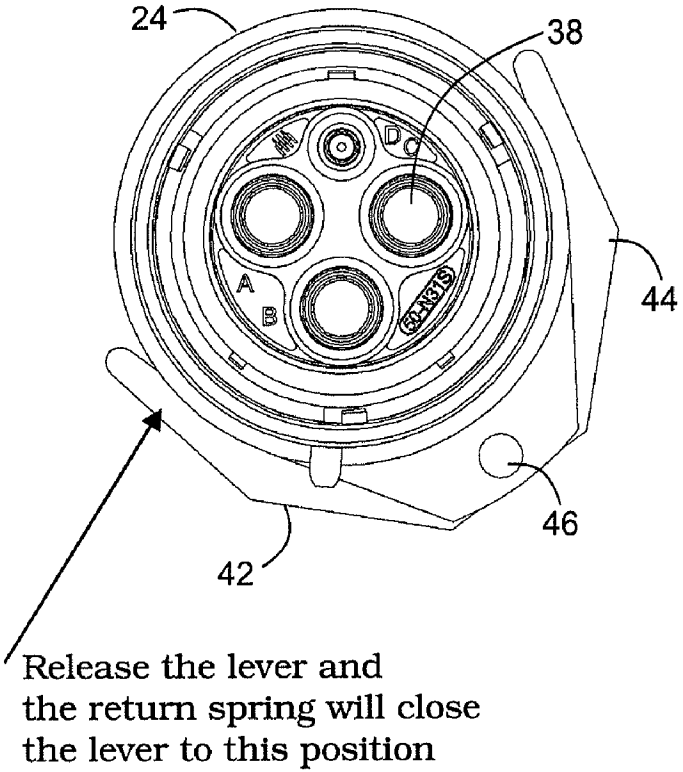
FIG. 7 is a front view as in FIG. 6 except the couple lever is released and closed.
Figure 10:
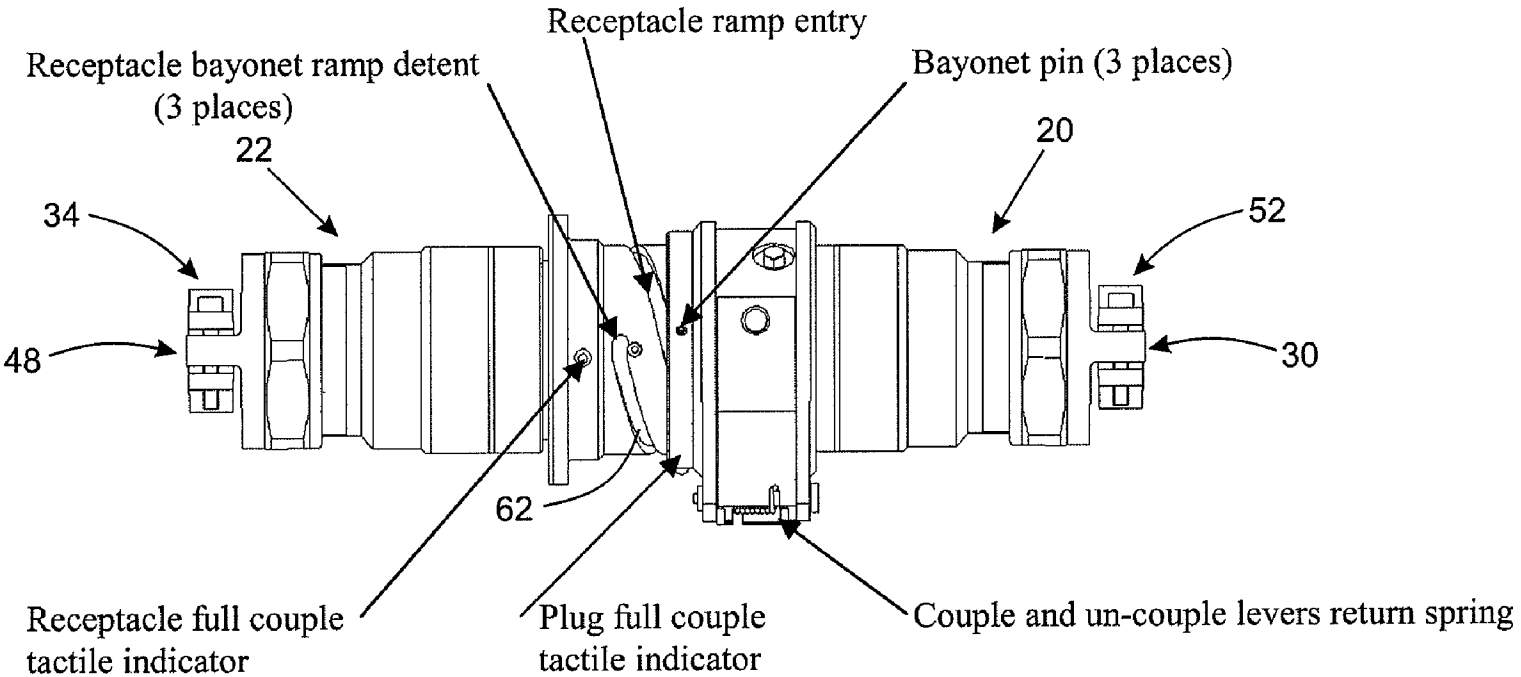
FIG. 10 is a side view showing the position of the plug connector entering the ramp of the receptacle when the coupling ring of the plug is rotated against an internal stop inside the plug.
Figure 11:
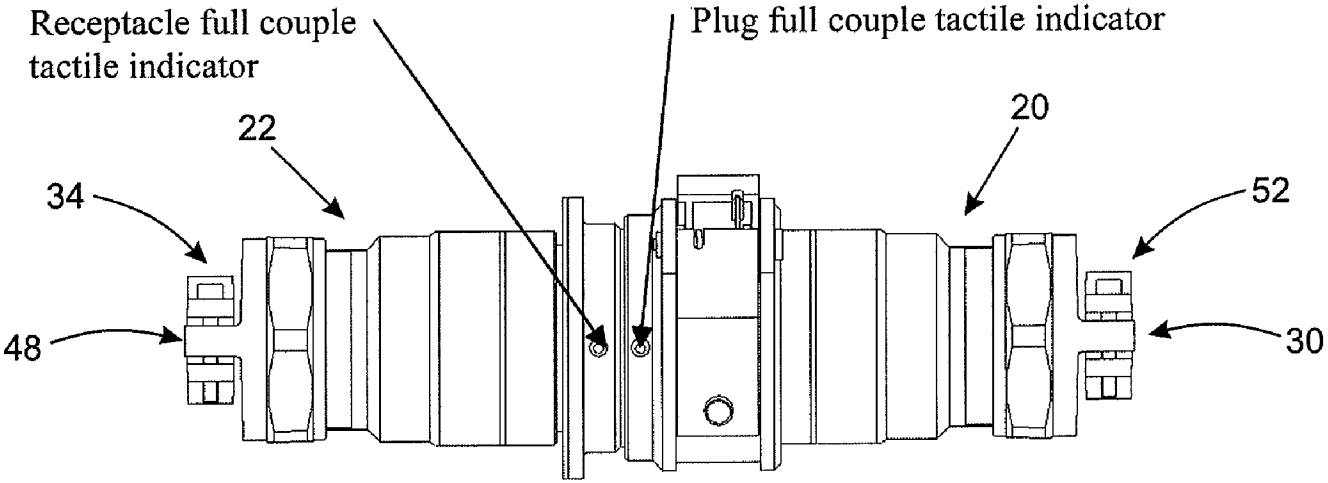
FIG. 11 is a side view of the plug and receptacle connector fully coupled showing the full couple tactile indicators in-line with each other.

FIGS. 3-7 illustrate coupling of the plug connector 20 to the receptacle connector 22 while FIG. 8 illustrate uncoupling. Turning to FIGS. 3-6 first, initially, the coupling ring 24 is rotated against the internal stop, mentioned above, as illustrated in FIG. 3 in order to align the plug connector 20 to the receptacle connector 22. The plug connector 20 and the receptacle connector 22 are moved toward each other so that the bayonet pins 60 on the coupling ring 24 enter the bayonet ramp entry point 64 of the receptacle connector 22, as illustrated in FIGS. 3 and 10. The coupling ring 24 is rotated in a coupling direction, as indicated by the arrow 74, until coupling resistance, as discussed above, is encountered as illustrated in FIG. 4. Additional force is applied to the lever 42 in order to rotate the coupling ring 24, as illustrated in FIG. 5, until the bayonet pins 60 on the coupling ring 24 reach the receptacle detent position 66, as illustrated in FIGS. 6 and 11, an audible click will be heard. The lever 42 is then released, in which case the torsion spring 72 causes lever to return to a storage position, as illustrated in FIG. 7.

While the coupling ring 24 is rotating, the bayonet pins 60 on the plug connector 20 follow the bayonet ramps 62 on the receptacle connector 22 because the ramps 62 slope away from the plug connector 20. As such, the plug connector 20 is pulled closer towards the receptacle connector 22 until the two connectors are fully coupled.

Uncoupling is illustrated in FIG. 8. In order to uncouple the plug connector 20 from the receptacle connector 22, the process is reversed. Initially, the lever 44 is rotated to a position in which the lever 44 stops against an adjacent surface of the coupling ring 24. Applying additional force to the lever 44 will rotate the coupling ring 24 out of the bayonet ramp detents 66 on the receptacle connector 22 and begin to disengage the connectors 20 and 22. At some point, the resistance to rotate will stop and the force of the lever return spring 79 to complete the rotation of the coupling ring 24 to the end of the rotation and allows the plug connector 20 to be disconnected and removed from the receptacle connector 22.

In accordance with an important aspect of the invention, the configuration of connectors provides a relatively compact design which enables them to be used in applications where space is relatively limited. In addition, the design enables multiple connectors to be placed side by side in close proximity to each other and can be coupled and un-coupled sequentially, as illustrated, for example, in FIG. 9.

Obviously, many modifications and variations of the present invention are possible in light of the above teachings. Thus, it is to be understood that, within the scope of the appended claims, the invention may be practiced otherwise than as specifically described above.

I claim:

1. An electrical power connector assembly comprising:

a first connector which includes a coupling ring; and a second connector configured to mate with sais first connector, said first connector and said second connector configured to be connected to electrical conductors on one end and mate with each other on an opposing end providing a continuous electrical connection therebetween, wherein said first connector includes a first rotatable lever, rotatably mounted to said coupling ring about an axis generally parallel to the axial axis of the plug connector for facilitating connection of the plug connector to the receptacle connector.

2. The electrical power connector as recited in claim 1, wherein said plug connector and said receptacle connector are generally circular in shape.

3. The electrical power connector as recited in claim 1, wherein said plug connector and said receptacle connector are formed with a reverse bayonet coupling configuration.

4. The electrical power connector as recited in claim 1, wherein said plug connector includes a rotatable coupling ring.

5. The electrical power connector as recited in claim 4, wherein said first rotatable lever is rotatably mounted to said coupling ring.

6. The electrical power connector as recited in claim 5, further including a second rotatable lever for facilitating disconnection of the plug connector to the receptacle connector.

7. The electrical power connector as recited in claim 6, wherein said second rotatable lever is rotatably mounted to said coupling ring.

8. The electrical power connector as recited in claim 7, wherein said second rotatable lever is rotatable about an axis generally parallel to the axial axis of the plug connector.

9. The electrical power connector as recited in claim 8, wherein said first rotatable lever and said second rotatable lever are rotatable about the same axis.

10. An electrical power connector assembly comprising:

a plug connector which includes a rotatable coupling ring;

a receptacle connector, said plug connector and said receptacle connector configured to be connected to electrical conductors on one end and mate with each other on an opposing end providing a continuous electrical connection therebetween, wherein said plug connector includes a first rotatable lever rotatably mounted to said coupling ring about an axis generally parallel to the axial axis of the plug connector for facilitating connection of the plug connector to the receptacle connector; and a second rotatable lever rotatably mounted relative to said coupling ring, said second rotatable lever for facilitating disconnection of the plug connector to the receptacle connector, wherein said plug connector includes a rotatable coupling ring and wherein said first rotatable lever is rotatably mounted to said coupling ring, wherein said first rotatable lever and said second rotatable lever are rotatable about an axis generally parallel to the axial axis of the plug connector and wherein said first rotatable lever is rotatable from a storage position in which the first rotatable lever is rests against the coupling ring and an extended position in which one end of the lever is stopped by the coupling ring to prevent additional rotation.

11. The electrical power connector as recited in claim 10, wherein said second rotatable lever is rotatable from a storage position in which the second rotatable lever is rests against the coupling ring and an extended position in which one end of the lever is stopped by the coupling ring to prevent additional rotation.

12. The An electrical power connector assembly comprising:

a plug connector which includes a rotatable coupling ring ; and a receptacle connector, said plug connector and said receptacle connector configured to be connected to electrical conductors on one end and mate with each other on an opposing end providing a continuous electrical connection therebetween, wherein said plug connector includes a first rotatable lever, rotatably mounted to said coupling ring about an axis generally parallel to the axial axis of the plug connector for facilitating connect ion of the plug connector to the receptacle connector, wherein said first rotatable lever is spring biased toward the coupling ring.

13. The electrical power connector as recited in claim 12, wherein said second rotatable lever is rotatably mounted to said coupling ring and said rotatable lever is spring biased toward the coupling ring.

14. The electrical power connector as recited in claim 13, wherein said first rotatable lever and said second rotatable lever is biased by the same spring.

15. The electrical power connector as recited in claim 13, wherein said first rotatable lever and said second rotatable lever is biased by different springs.

16. The An electrical power connector assembly comprising:

a plug connector which includes a rotatable coupling ring ;

a receptacle connector, said plug connector and said receptacle connector configured to be connected to electrical conductors on one end and mate with each other on an opposing end providing a continuous electrical connection therebetween, wherein said plug connector includes a first rotatable lever, rotatably mounted to said coupling ring about an axis generally parallel to the axial axis of the plug connector for facilitating connect ion of the plug connector to the receptacle connector; and a second rotatable lever, rotatably mounted to said coupling ring, for facilitating disconnection of the plug connector to the receptacle connector, said second rotatable lever being rotatable about an axis generally parallel to the axial axis of the plug connector, wherein said first rotatable lever and said second rotatable lever are rotatable about different axes.

17. An electrical power connector assembly comprising;

a plug connector which includes a rotatable coupling ring ;

a receptacle connector, said plug connector and said receptacle connector configured to be connected to electrical conductors on one end and mate with each other on an opposing end providing a continuous electrical connection therebetween, wherein said plug connector includes a first rotatable lever, rotatably mounted to said coupling ring about an axis generally parallel to the axial axis of the plug connector for facilitating connect ion of the plug connector to the receptacle connector; and a second rotatable lever, rotatably mounted to said coupling ring, for facilitating disconnection of the plug connector to the receptacle connector, said second rotatable lever being rotatable about an axis generally parallel to the axial axis of the plug connector, wherein said first rotatable lever is rotatable from a storage position in which the first rotatable lever is rests against the coupling ring and an extended position in which one end of the lever is stopped by the opposing lever to prevent additional rotation.

* * * * *